US005605064A

United States Patent [19]

Katayama et al.

[11] Patent Number: 5,605,064

[45] Date of Patent: Feb. 25, 1997

[54] DOOR LOCK FOR HANDICAPPED PERSONS

[75] Inventors: Akira Katayama; Kimikazu Hoshikawa, both of Tokyo-to, Japan

[73] Assignee: Miwa Lock Co., Ltd., Tokyo, Japan

[21] Appl. No.: 272,175

[22] Filed: Jul. 8, 1994

[30] Foreign Application Priority Data

Apr. 21, 1994 [JP] Japan ..... 6-107732

[51] Int. Cl.[6] ..... E05B 13/10

[52] U.S. Cl. ..... 70/224; 70/215; 70/370; 292/336.3; 292/358

[58] Field of Search ..... 70/224, 358, 370, 70/195, 201, 215, 216, DIG. 39; 292/336.3, 347, 358

[56] References Cited

U.S. PATENT DOCUMENTS

| | | | |
|---|---|---|---|
| 1,892,709 | 1/1933 | Shaw | 70/224 |
| 2,023,941 | 12/1935 | Voight | 70/224 |
| 2,062,487 | 12/1936 | Voight | 70/224 |
| 3,718,015 | 2/1973 | Tornue et al. | 70/224 |
| 4,604,879 | 8/1986 | Neary et al. | 70/224 |
| 5,077,994 | 1/1992 | Trull et al. | 70/224 |
| 5,141,269 | 8/1992 | Haq et al. | 292/169 |
| 5,317,889 | 6/1994 | Solovieff et al. | 70/224 |
| 5,398,531 | 3/1995 | Shen | 70/224 |

*Primary Examiner*—Lloyd A. Gall

*Attorney, Agent, or Firm*—Edwin E. Greigg; Ronald E. Greigg

[57] ABSTRACT

A door lock which does not decrease the strength of an outer end portion of the outside rotary shaft includes an inside lever handle and an outside lever handle which are attached to a lock body assembled into the door, and a retracting operation of a latch bolt of a latch arranged on latch shaft perpendicular to a handle shaft is carried out by rotation of an inside or an outside rotary shaft of the lock body. A cut portion for drive opposite to a slot of an enlarged portion is formed at an inner circumferential wall of a tubular fitting portion of the outside lever handle, and that left and right cover portions in a projection form of an outer tube of the cylinder lock are respectively fitted over the cut portion for drive and the slot through left and right cut portions of the outside rotary shaft.

5 Claims, 11 Drawing Sheets

DOOR LOCK FOR HANDICAPPED PERSONS

RELATED APPLICATION

This application is copending with application Ser. No. 08/272,176, filed on Jul. 8, 1994.

BACKGROUND OF THE INVENTION

This invention relates to a door lock, and more particularly to a door lock having a lever handle used in the case where a person having trouble in use of the hand can easily rotate the knob.

An example of conventional door locks of this kind is described in the U.S. Pat. No. 5,141,269 or the Japanese Published Patent Application No. 297681/1992 (Tokkaisho No. 4-297681).

The fundamental configuration of this example of prior art will now be described with reference to FIGS. 12 to 15.

Reference numeral 1 denotes a door pivotally supported by the door frame so that it can be opened. A door lock 2 having an inside lever handle 3 positioned on the indoor side and an outside lever handle 4 positioned on the outdoor side is attached on the door 1.

Moreover, reference numeral 5 denotes a lock body of door lock 2. An actual structure of the lock body 5 is described in the above-mentioned publication and the U.S. Pat. No. 4,604,879. Namely, the lock body 5 comprises a housing 7 opened at one side wall and having an annular wall 6 on the other side wall, a support frame (not shown) fixedly provided within the housing, a slide body 29 for a latch which is advanced or withdrawn within the support frame, an attachment block for a fixed plate having female screws, a bearing member, a rotary shaft, and the like.

Reference numeral 8 denotes a latch having a latch bolt 9 held by the latching slide body 29 of the lock body 5. This latch 8 is arranged along a latch axis 11 perpendicular to a handle axis 10 of lever handles 3, 4, as shown in FIG. 12. A front plate 12 opposite to a strike plate provided at the door frame (not shown) is provided at latch 8.

Reference numeral 13 denotes a cylindrical bearing member fixedly provided on housing 7 of lock body 5. This bearing member 13 has a male screw thread 14 at the outer circumferential surface, and is projected from annular wall 6 of the housing 7.

Reference numeral 15 denotes an outside fixed plate fixedly provided at the housing so that it is positioned at the opening side of the housing 7. This outside fixed plate 15 has a plurality-of projections 16 stuck into an outer wall 1*a* of door 1 at the internal surface thereof.

Reference numeral 17 denotes an inside fixed plate fixed through plural small screws 18 on the housing so that it is positioned on the annular wall 6 side of housing 7. This inside fixed plate 17-also has, at the inner surface thereof, a plurality of projections 19 stuck into inner wall 1*b* of door 1. The inside fixed plate 17 is securely fixed on the housing 7 by small screws 18 respectively penetrated through a pair of penetration holes 20 formed at the inside fixed plate and a plurality of penetration holes 21 formed at annular wall 6 of housing 7. The outside and inside fixed plates 15, 17 are caused to be opposite to each other when they are respectively thrust against wall surfaces 1*a*, 1*b* of door 1. It is to be noted that small screws 18 penetrate through apertures 21 of housing 7 and are screw-connected to female connections of the attachment block for the fixed plate (not shown) within housing 7.

Reference 22 denotes a hexagonally-shaped nut having a flange portion 23 in contact with the outer wall surface of inside fixed plate 17 and a tubular portion 25 penetrated through a center hole 24 of inside fixed plate 17.

This hexagonally shaped nut 22 has a female screw thread 26, which is screw-connected to the male screw thread 14 of the previously described bearing member 13. This hexagonally-shaped nut 22 serves to limit the inside fixed plate 17 so that it is located at a predetermined position, and to prevent small screws 18 from being loosened.

Reference numerals 27, 28 denote inside and outside tubular rotary shafts disposed on the handle shaft 10. The end portions of these rotary shafts 27, 28 are respectively combined into the lock body 5 to advance or withdraw the latching slide body 29 through engagement cam pieces 39 (best shown in FIGS. 14–15) formed at the inner end portions of the rotary shafts as projection therefrom. Further, inside and outside lever handles 3, 4 are respectively fitted over the outer end portions of said shafts having a plurality of cut portions (elongated openings) 27*a*, 27*b*, 27*c*, 28*a*, 28*b*, 28*c*. In addition, the retracting operation of the previously described latch bolt 9 is carried out by rotation of the inside or outside rotary shaft 27 or 28.

Reference numerals 30, 31 denote inside and outside return spring covers disposed on the handle shaft 10, respectively. These return spring covers 30, 31 are formed separately from fixed plates respectively disposed opposite thereto in this embodiment.

Moreover, these return spring covers 30, 31 have internally thereof spring members 32 for respectively returning lever handles 3, 4 to the initial positions. Further, these return spring covers 30, 31 have a pair of threaded nipples 33 projected from the inside walls, respectively. In addition, the inside return spring cover 30 and the outside return spring cover 31 are integrally connected through large screws 34 screw-connected to the female screw portions 33.

Reference numerals 35, 36 denote inside and outside decorative caps disposed on the handle shaft, respectively.

It is to be noted that reference numeral 38 denotes a turn button assembled into a penetration hole 37 of the inside lever handle 3. Further, reference numeral 40 denotes a cylinder lock fitted into the outside lever handle 4.

Meanwhile, cylinder lock 40 comprises an inner tube 41, an outer tube 42, an engagement piece 43 in a bar form, and one cover portion 44 in a projection form for accommodating a pin tumbler provided on the outer tube 42.

Moreover, an enlarged portion 48 having a slot 47 is formed on the handle 46 side of a tubular fitting portion 45 formed on outside lever handle 4.

Further, two engagement projections 49 are oppositely formed in a direction of handle axis 10 at the inner circumferential wall of the tubular fitting portion 45 as shown in FIG. 15.

In the above-mentioned configuration, two cut portions 28*a*, 28*b* oppositely disposed in the peripheral surface of outside rotary shaft 28 are respectively engaged with the two engagement projections 49, 49 of outside lever handle 4. Further, cover portion 44 of cylinder lock 40 is engaged with another cut portion 28*c* of outside rotary shaft 28.

Accordingly, when outside lever handle 4 is rotated, its rotational force is directly transmitted to the outside rotary shaft 28. As a result, outer tube 42 of cylinder lock 40 rotates along with outside rotary shaft 28 through a third cut portion of the outside rotary shaft in an unlatching (unlocking) state.

However, the door lock 2 thus constructed had the following drawbacks.

(1) Since cut portions 28*a*, for the drive are subject to a rotational force from the outside lever handle 4 and cut portion 28*c* with which cover portion 44 of cylinder lock 40 is engaged are respectively separately formed, there results an increased number of cut portions. Accordingly, the strength of the outer end portion of the outside rotary shaft 28 declines.

(2) When outside rotary shaft 28 rotates somewhat in the case where a burglar forcedly rotates outside lever handle 4 in one direction with cylinder lock 40 being in a latch (lock) state, the end surface of cut portion 28*c* directly comes into contact with the outer wall of cover portion 44 of cylinder lock 40. Accordingly, it is unable to sufficiently protect cover portion 44 of cylinder lock 40.

(3) In the case where outside lever handle 4 is rotated in an unlatching (unlocking) direction, outside rotary shaft 28 is rotated. As a result, latching slide body 29 is withdrawn into housing 7 of lock body 5 by the cam mechanism. Accordingly, when a burglar attempts to further forcedly rotate the outside lever handle 4 in excess of the limit (limiting point) of withdrawal movement of latching slide body 29, small screws 18 are deformed. For this reason, housing 7 of lock body 5 is separated from inside fixed plate 17 and is rotated by itself. Accordingly, latch bolt 9 of latch 8 disengaged from latching slide body 29 of lock body 5.

(4) Return spring covers 30, 31 and fixed plates 15, 17 are respectively formed as separate bodies. For that reason when it is necessary to fixedly attach fixed plates 15, 17 to housing 7, one is unable to attach door lock 2 to door 1 with ease.

SUMMARY OF THE INVENTION

In view of drawbacks with the prior art as described above, an object of this invention is to provide a door lock of a structure such that the strength of the outer end portion of outside rotary shaft 28 does not decline, which can protect the cover portion of cylinder lock even if a burglar forcedly rotates outside lever handle 4 in one direction, and which can sufficiently cope with measures to counter torsion applied to the outside lever handle.

To achieve the above-described object, in accordance with this invention, there is provided a door lock in which inside lever handle 3A and outside lever handle 4A are attached on lock body 5 assembled into door A, and retracting operation of latch bolt 9 of latch 8 disposed on latch shaft 11 perpendicular to handle shaft 10A is carried out by rotation of inside or outside rotary shaft 27A or 28A of lock body 5A, characterized in that a cut portion 87 for a drive disposed opposite to slot 47A of an enlarged portion 48A is formed at the inner circumferential wall 86 of tubular fitting portion 45A of the outside lever handle 4A, that left and right cover portions 84, 85 formed as projections from outer tube 42A of cylinder lock 40A are respectively fitted into the cut portion for the drive and the slot through left and right cut portions 82, 83 of outside rotary shaft 28A, and that at least two engagement projections for drive 88, 88B, 89, 89B which are respectively in contact with the end surface of the cut portion of outside rotary shaft 28A are formed at suitable portions of inner circumferential wall 86 of tubular fitting portion 45A.

DESCRIPTION OF THE PREFERRED EMBODIMENT

Figure 1:
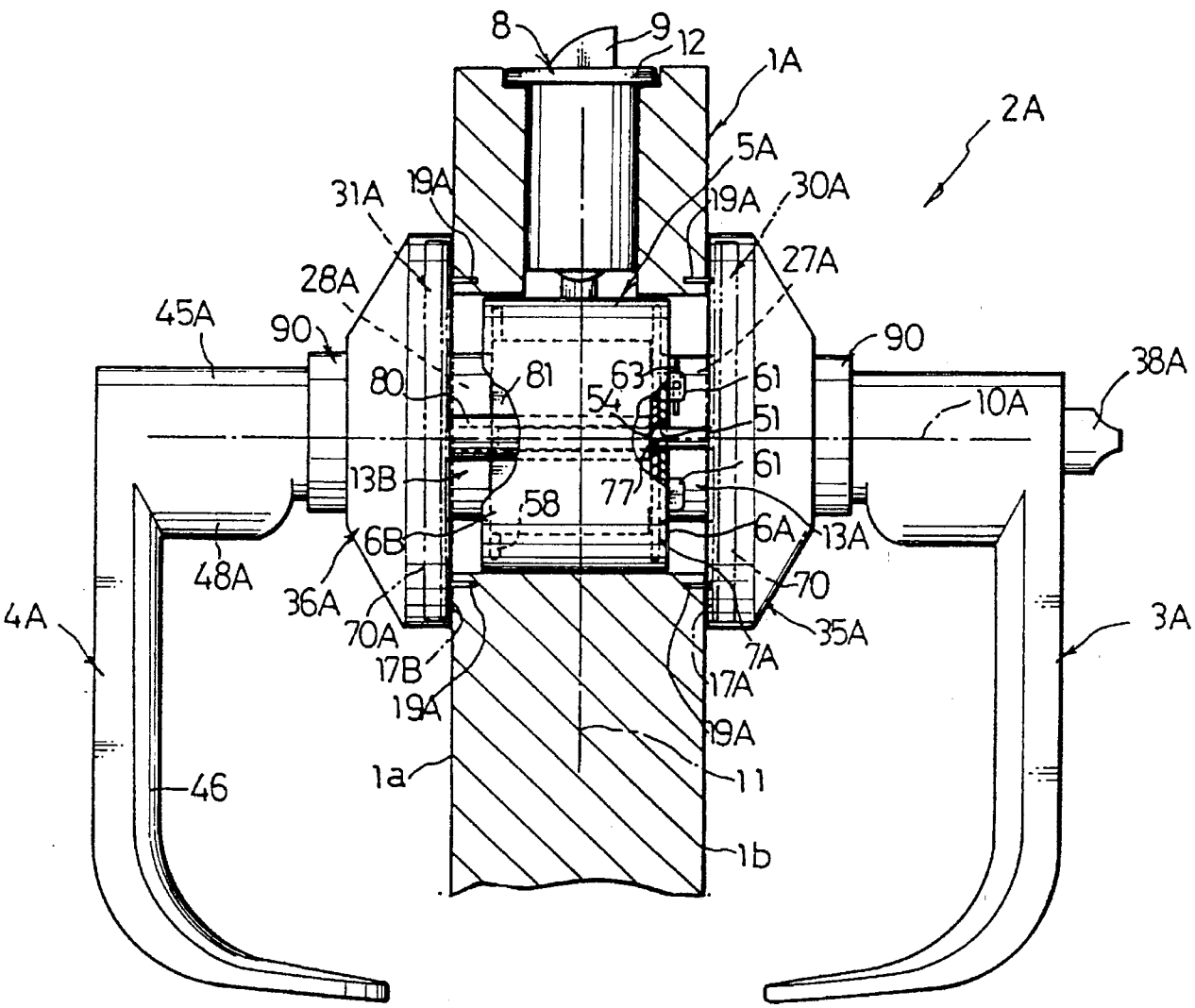
FIG. 1 is an explanatory view showing the attachment state of a door lock according to an embodiment of this invention.
Figure 2:
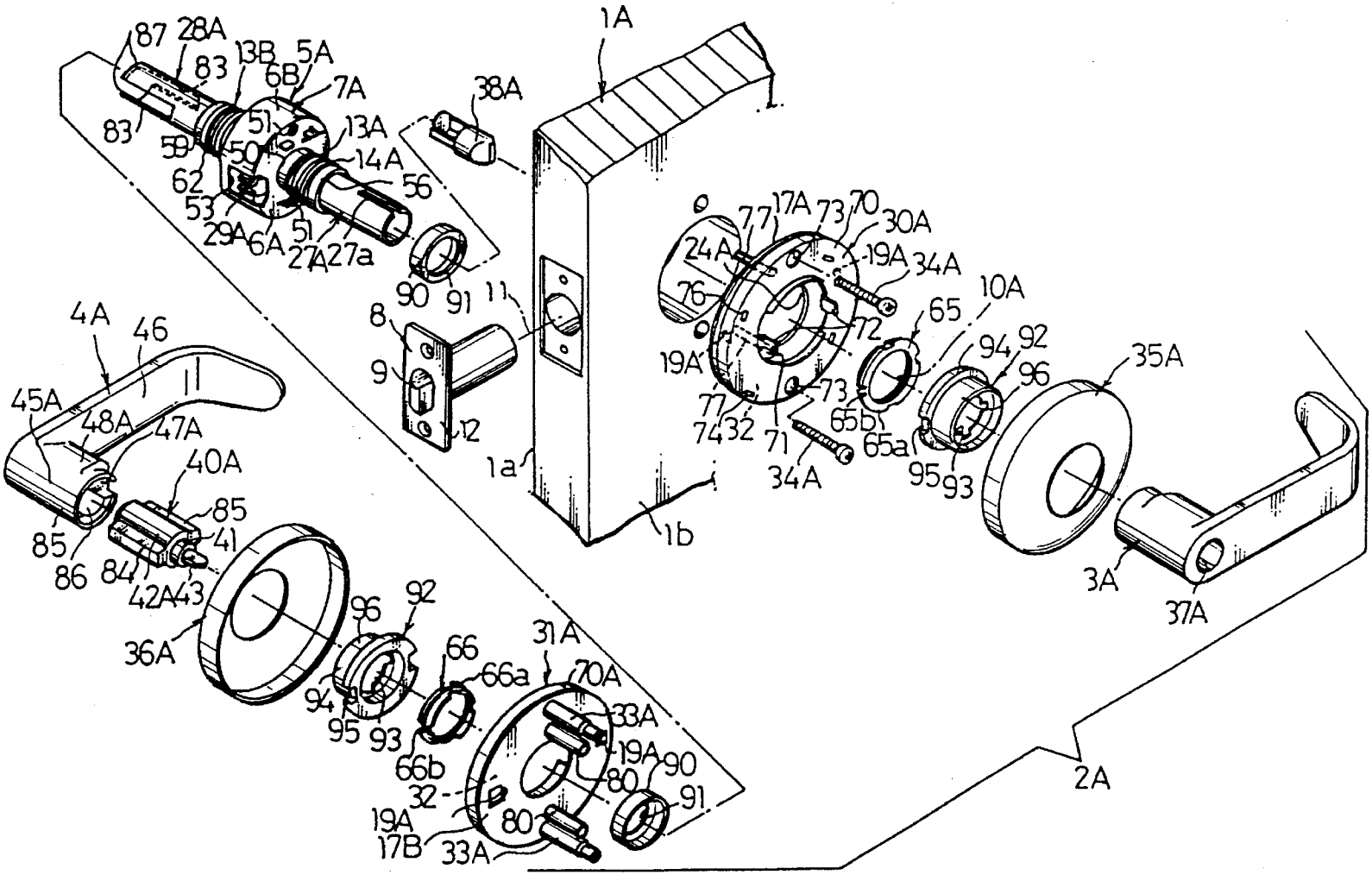
FIG. 2 is an exploded perspective view of the door lock shown in FIG. 1.

This invention will now be described in detail in connection with the preferred embodiment shown. In the description of this embodiment, the same or similar reference numerals are respectively attached to the same portions of the conventional door lock, and the repetitive explanation will be omitted.

Figure 3:
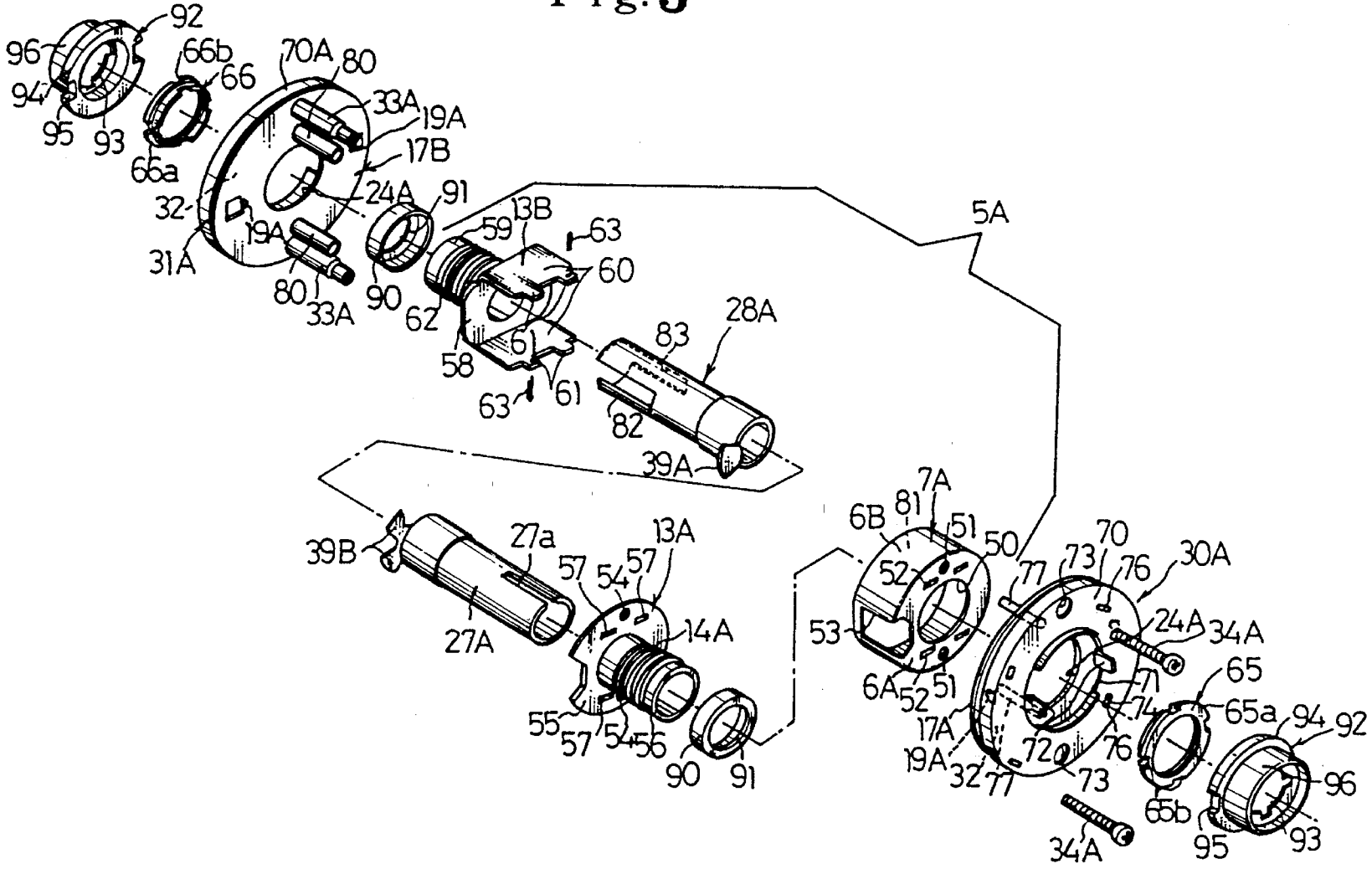
FIG. 3 is an exploded perspective view of the essential parts of this invention.
Figure 4:
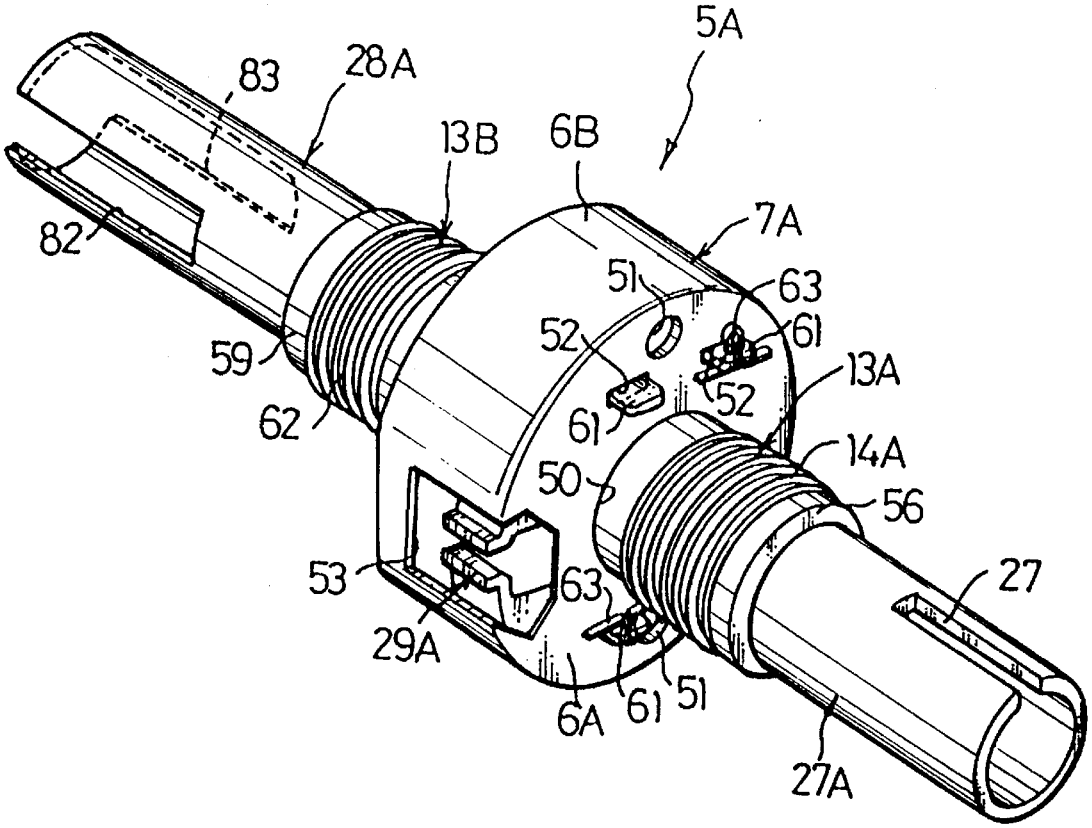
FIG. 4 is a perspective view of the essential parts of this invention.
Figure 5:
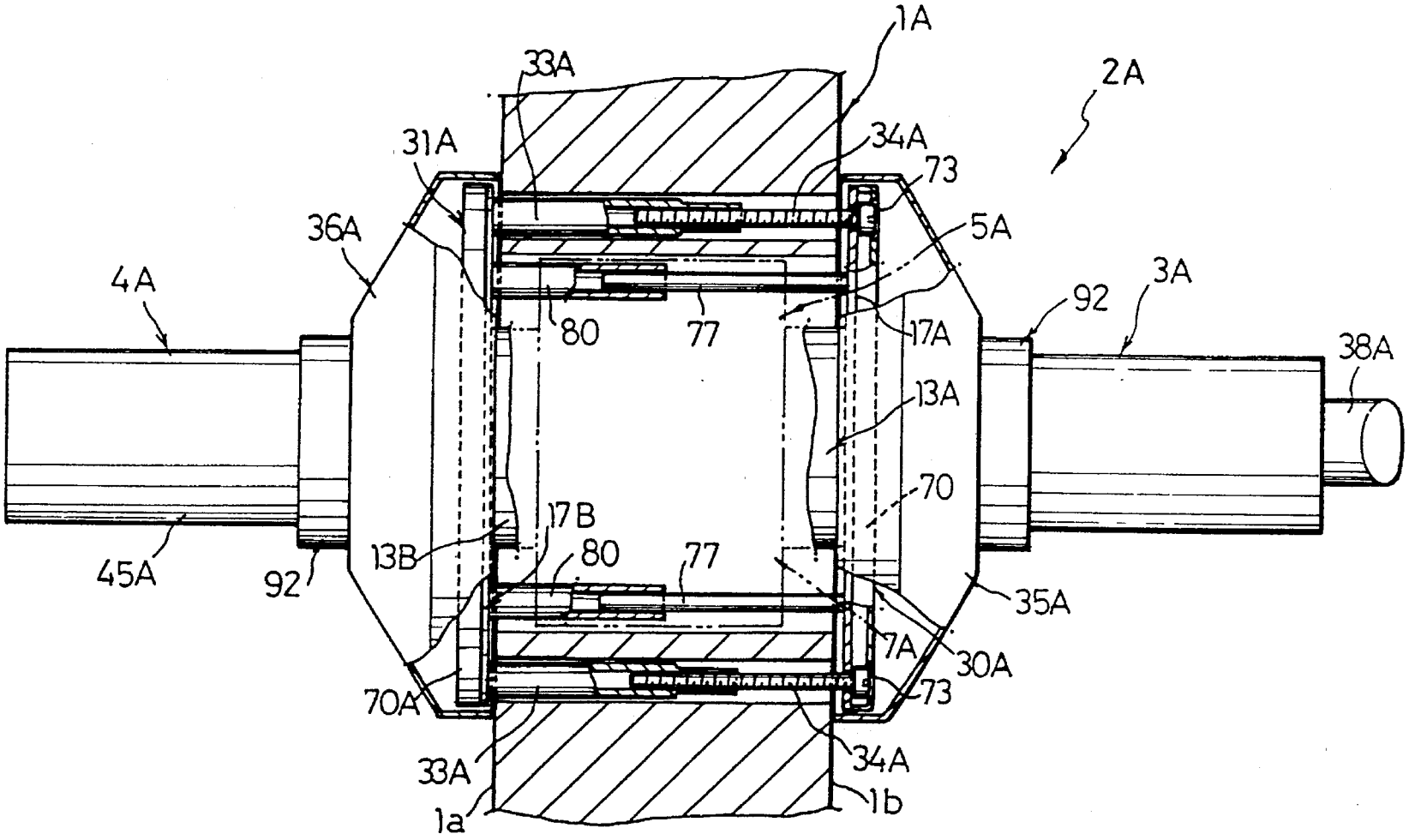
FIG. 5 is a partially cross sectional view in the attachment state of the door lock of this invention.

In FIGS. 1 to 7, reference numeral 1A denotes a door and reference numeral 2A denotes a door lock. Further, reference numeral 3A denotes an inside lever handle, reference numeral 4A denotes an outside lever handle, reference numeral 5A denotes a lock body, and reference numeral 6A denotes an annular wall of housing 7A of the lock body. At the annular wall 6A, as shown in FIG. 4, a center hole 50 for an inside rotary shaft, a pair of penetration holes, engagement portions 51 for measures to counter torsion such as an engagement cut portion, and a plurality of attachment holes 52 for inside bearing members are respectively formed. Further, at circumferential wall 6B of housing 7A, a window portion 53 through which engagement portions of latching slide body 29A can be seen is formed.

Reference numeral 13A denotes an inside bearing member fixedly attached to housing 7A of lock body 5A. This inside bearing member 13A is fitted into the housing 7A from the opening side thereof. The inside bearing member 13A is composed, as shown in FIG. 3, of a flange plate 55 in contact with the inner wall of annular wall 6A of housing 7A, and a cylindrical portion 56 which is integrally provided at the flange plate 55 and is projected from center hole 50 of housing 7A. At the flange plate 55, a plurality of rectangular penetration holes 57 in correspondence with attachment holes 52 of annular wall 6A and penetration holes 54 engaged with engagement rods of a fixed plate which will be described later are formed. This penetration hole 54 may be a cut portion. In addition, a first adjustment screw 14A is formed at the outer circumferential wall of cylindrical portion 56.

Reference numeral 13B denotes an outside bearing member fixedly attached within housing 7A of lock body 5A. This outside bearing member 13B is also fitted into the housing 7A from the opening side thereof. The outside bearing member 138 is composed, as shown in FIG. 3, of a supporting wall 58 having a vertical portion positioned at the opening of housing 7A, and a cylindrical portion 59 which is provided integrally with the vertical portion of this supporting wall 58 and is projected toward the outside of housing 7A. At the front end portions of upper and lower horizontal supporting portions 60 oppositely disposed to the supporting wall 58, there are provided, in this embodiment, four engagement projections 61 which penetrate through penetration holes 57 of the previously described inside bearing member 13A and attachment holes 52 of housing 7A. Further, a second adjustment screw 62 is formed at the outer circumferential wall of cylindrical portion 59. The outside bearing member 13B is fixed at a predetermined position by pins 63 for prevention of slip-off which are engaged with engagement projections 61 penetrated through housing 7A.

Reference numeral 65 denotes a first adjustment ring screw-connected to first adjustment screw 14A of inside bearing member 13A. On the other hand, reference numeral 66 denotes a second adjustment ring screw-connected to second adjustment screw 62 of outside bearing member 13B. The first and second adjustment rings 65, 66 are used in the case where door lock 2A is attached in correspondence with the thickness of door 1A. Accordingly, first and second adjustment rings 65, 66 respectively have flanges 65*a*, 66*a* adapted to be in contact with fixed plates of return spring covers which will be described below. At the flanges 65*a*, 66*a*, a plurality of engagement grooves 65*b*, 66*b* for rotating the first and/or second adjustment rings 65, 66 by using a driver tool (not shown) are formed.

Reference numerals 30A, 31A respectively denote inside and outside return spring covers arranged on handle shaft 10A. These return spring covers 30A, 31A are formed integrally with fixed plates respectively opposite to housing 7A in this embodiment.

The inside return spring cover 30A will be first described. Reference numeral 70 denotes an annular outside case having a fitting hole 71 formed so that its diameter is greater than the diameter of center hole 50 of housing 7A of lock body 5A. At the inner edge of the outside case 70, a pair of stopper pieces 72 extending in a direction of handle shaft 10A are provided. Further, penetration holes in a form of circular hole 73 for a large screw 34A are formed at suitable portions oft he outside case 70. Furthermore, a plurality of square attachment holes 74 are formed at the outside case 70 at predetermined intervals. Reference numeral 17A denotes an annular inside fixed plate fixed on outside case 70 through a plurality of engagement pieces 76 engaged with the attachment holes 74. This inside fixed plate 17A has a plurality of projections 19A adapted to be stuck into inner wall 1*b* of door 1A at the internal surface as shown in the prior art. At the inside fixed plate 17A, there are provided, in this embodiment, a pair of insertion rods 77 as engagement rods adapted to be inserted into penetration holes 51 of housing 7A of lock body 5A for measures to counter torsion. While it is sufficient that a single engagement rod 77 is provided, it is desirable that a plurality of engagement rods 77 are provided. It is to be noted that center hole 24A of inside fixed plate 17A is smaller than fitting hole 71 of outside case 70.

The outside return spring cover 31A will now be described. This outside return spring cover 31A is of a structure similar to that of the inside return spring cover 30A. Accordingly, the same reference numerals are respectively attached to the same portions and the repetitive explanation is omitted. In this example, reference numeral 17B denotes an outside fixed plate, and reference numeral 70A denotes an outside case.

Accordingly, portions different from those of inside return spring cover 30A will now be described. Reference numeral 80 denotes a pair of alignment tubes provided in a projected manner at outside fixed plate 17B. As shown in FIG. 1, these alignment tubes 80 are inserted into a space portion 81 between the inner wall of housing 7A and the outer wall of supporting wall 58 of outside bearing member 13B, and are fitted over locating rods 77 of inside return spring cover 30A inserted into penetration hole 51 for measures to counter torsion of housing 7A. Reference numeral 33A denotes a pair of internally threaded nipples provided in a projected manner at outside fixed plate 17B. These internally threaded nipples 33A are positioned outside alignment tubes 80 and are provided in parallel to the alignment tubes 80. In this embodiment, threaded nipples 33A are slightly longer than the alignment tubes 80. The return spring covers 30A, 31A can be brought closer to the side of housing 7A or be spaced away therefrom by adjusting positions of first and/or second adjustment rings 65, 66. Further, the return spring covers 30A, 31A are integrally fixed by large screws 34A penetrated through penetration holes 73 of inside return spring cover 30A, and screw-connected to threaded nipples 33A of outside return spring cover 31A.

Reference numerals 27A, 28A denote inside and outside tubular rotary shafts disposed on handle shaft 10A. The end portions of these rotary shafts 27A, 28A are respectively assembled into the lock body 5A. At respective inner end portions of rotary shafts 27A, 28A, engagement cam pieces 398, 39A are formed as projections which are engaged with the side wall of latching slide body 29A.

Figure 6:
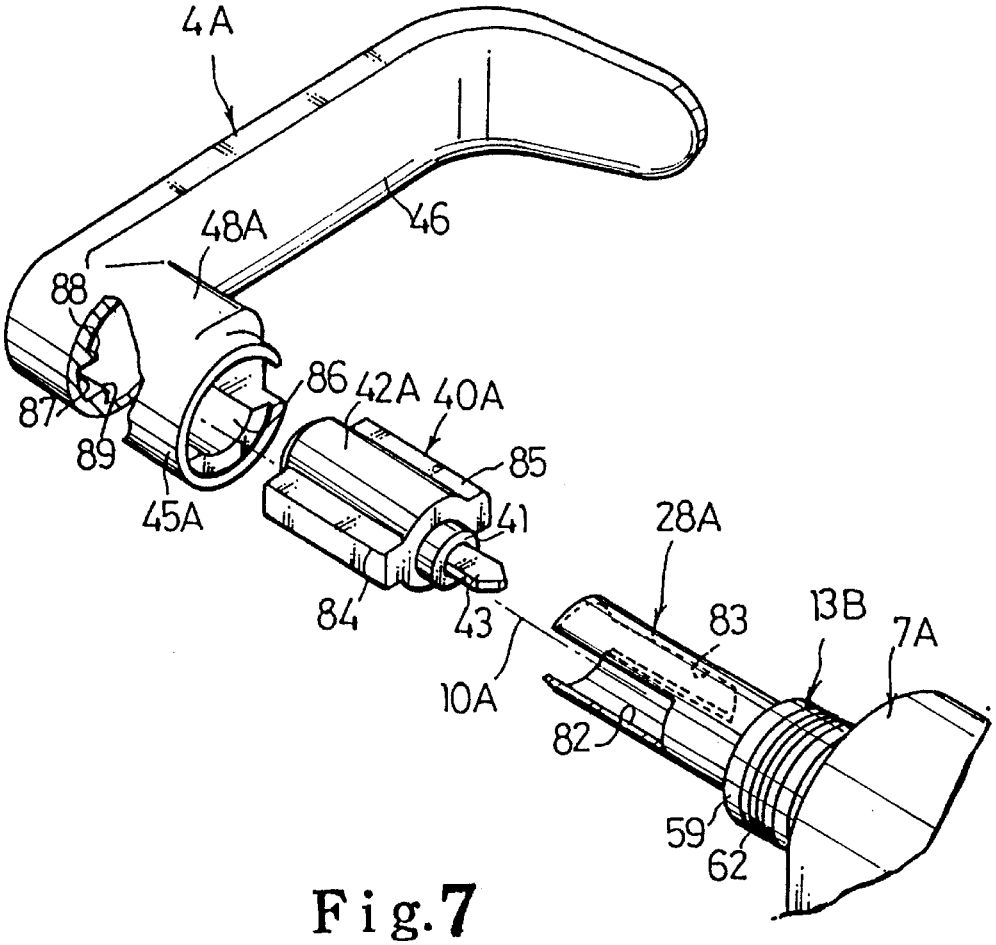
FIG. 6 is an explanatory view showing the relationship of the essential parts (outside lever handle, cylinder lock and outside rotary shaft) of this invention.
Figure 7:
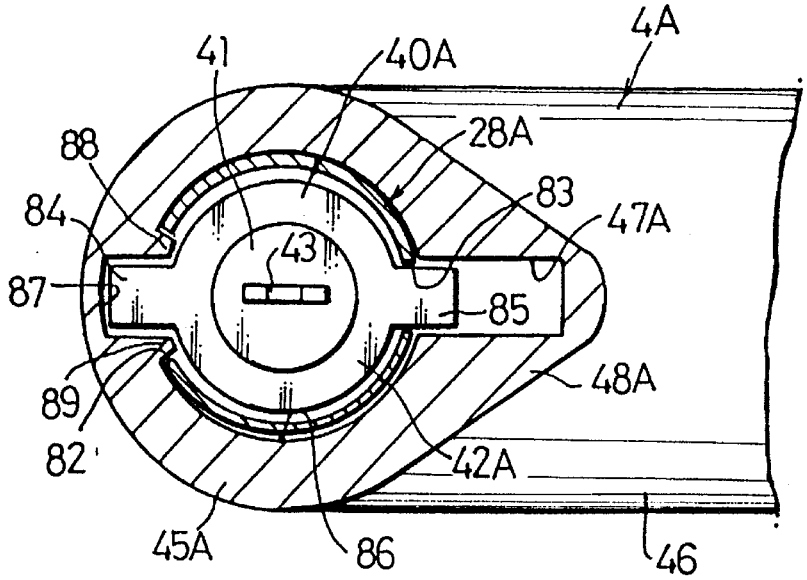
FIG. 7 is a schematically explanatory view showing the state where respective members in FIG. 6 are combined.

Meanwhile, at the external end portion of this outside rotary shaft 28A, as shown in FIGS. 6 and 7, cut portions 82, 83 are provided in a direction of handle shaft 10A to be fitted to left and right cover portions 84, 85 which are projections of cylinder lock 40A including a magnet pin tumbler; these projections are formed in such a manner that they are oppositely disposed in left and right directions.

When the state of FIG. 7 is taken as a reference, a first (left) cover portion 84 engaged with the first cut portion 82 is formed in a projected manner at the left side of outer tube 42A of cylinder lock 40A. On the other hand, a second (right) cover portion 85 engaged with the second cut portion 83 is formed in a projected manner at the right side of outer tube 42A.

Moreover, a cut portion 87 for a rotational drive disposed opposite to slot 47A of enlarged portion 48A is formed at an inner circumferential wall 86 of a tubular fitting portion 45A of the outside lever handle 4A. To the cut portion 87 for a rotational drive and the slot 47A, left and right cover portions 84, 85 formed as projections from outer tube 42A of cylinder lock 40A are respectively fitted through left and right cut portions 82, 83 of outside rotary shaft 28A.

Further, two engagement projections 88, 89 for driving engagement with the cover portions 84, 85 are respectively in contact with the end surface of first cut portion 82 of the outside rotary shaft 28 and formed at suitable portions of inner circumferential wall 86 of tubular fitting portion 45A. These engagement projections 88, 89 for a rotational drive are formed in this embodiment so as to respectively oppose inner circumferential wall 86 of tubular fitting portion 45A forming cut portion 87 for rotational drive.

Figure 8:
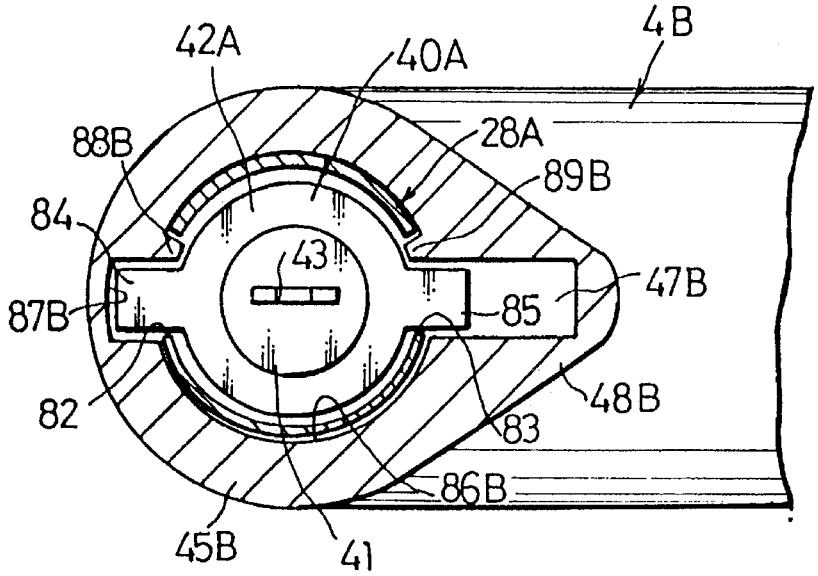
FIG. 8 is an explanatory view showing a first modification of the essential parts (outside lever handle, cylinder lock, outside rotary shaft) of this invention.

In this case, engagement projections 88B, 89B for rotational drive of outside lever handle 4B may be formed symmetrically to inner wall 86B of tubular fitting portion 45B forming a cut portion 87B for the drive and inner wall 86B forming a slot 47B of enlarged portion 48B,as shown in FIG. 8.

Figure 9:
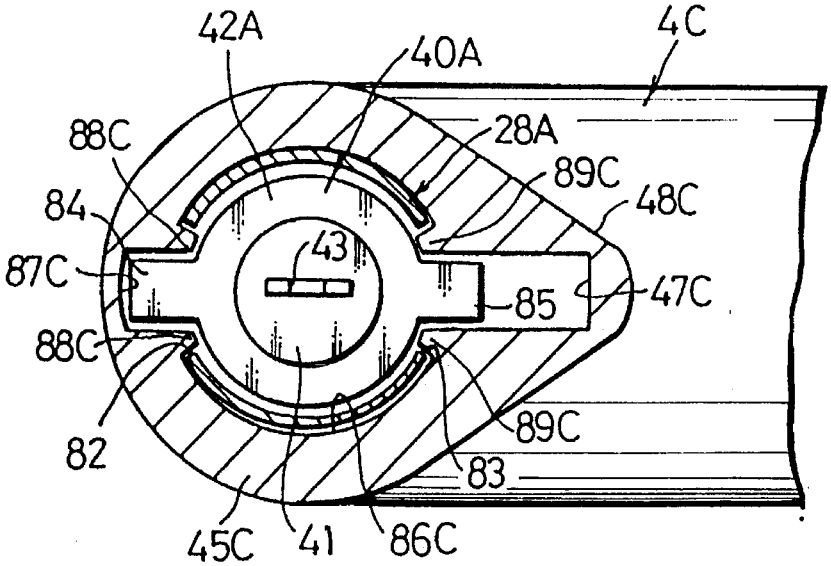
FIG. 9 is an explanatory view showing a second modification of the essential parts (outside lever handle, cylinder lock, outside rotary shaft) of this invention.

Further, as shown in FIG. 9, there may be employed a configuration in which respective two engagement projections 88C, 89C for drive of outside lever handle 4C are formed on inner wall 86C of tubular fitting portion 45C forming cut portion 87C for the drive, and are formed on inner wall 86C forming slot 47C of the enlarged portion 48C. These engagement projections 88C, 89C for drive may be disposed symmetrically to each other.

Figure 10:
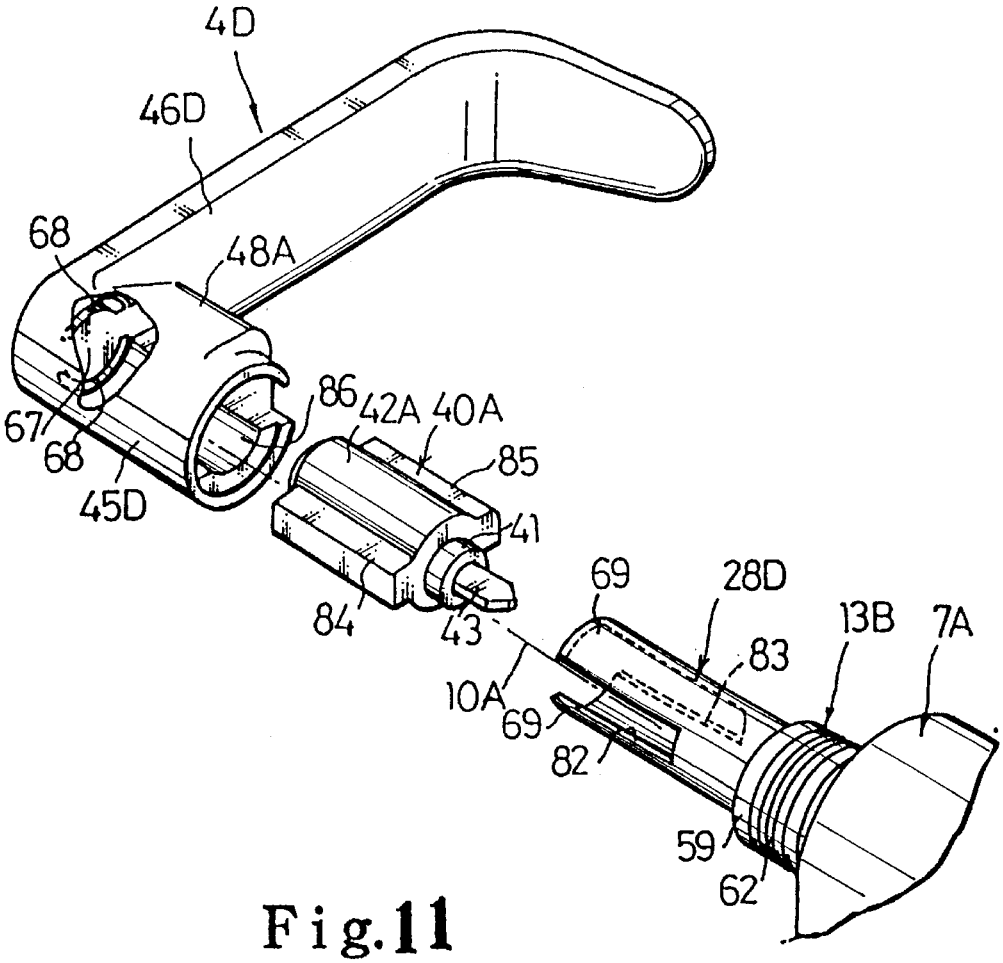
FIG. 10 is an explanatory view showing a third modification of the essential parts (outside lever handle, cylinder lock, outside rotary shaft) of this invention.
Figure 11:
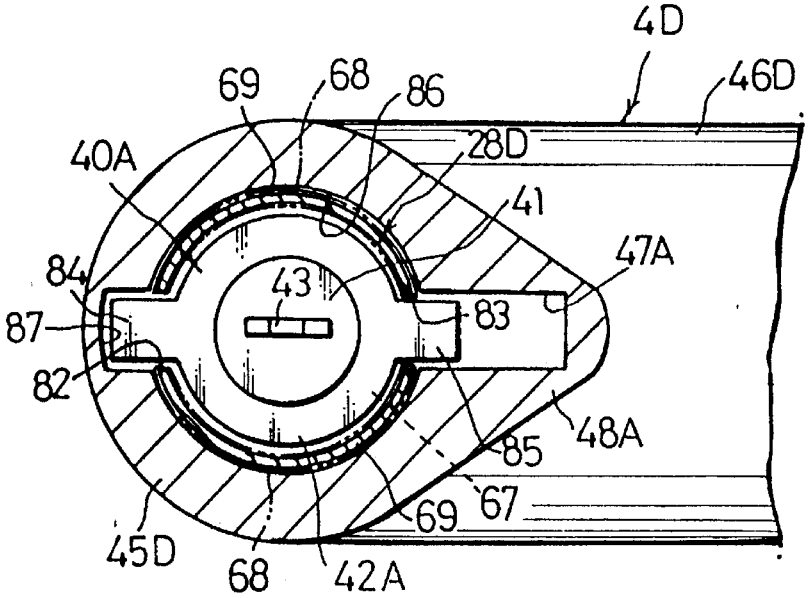
FIG. 11 is a schematic explanatory view showing the state where respective members in FIG. 10 are combined.
Figure 12:
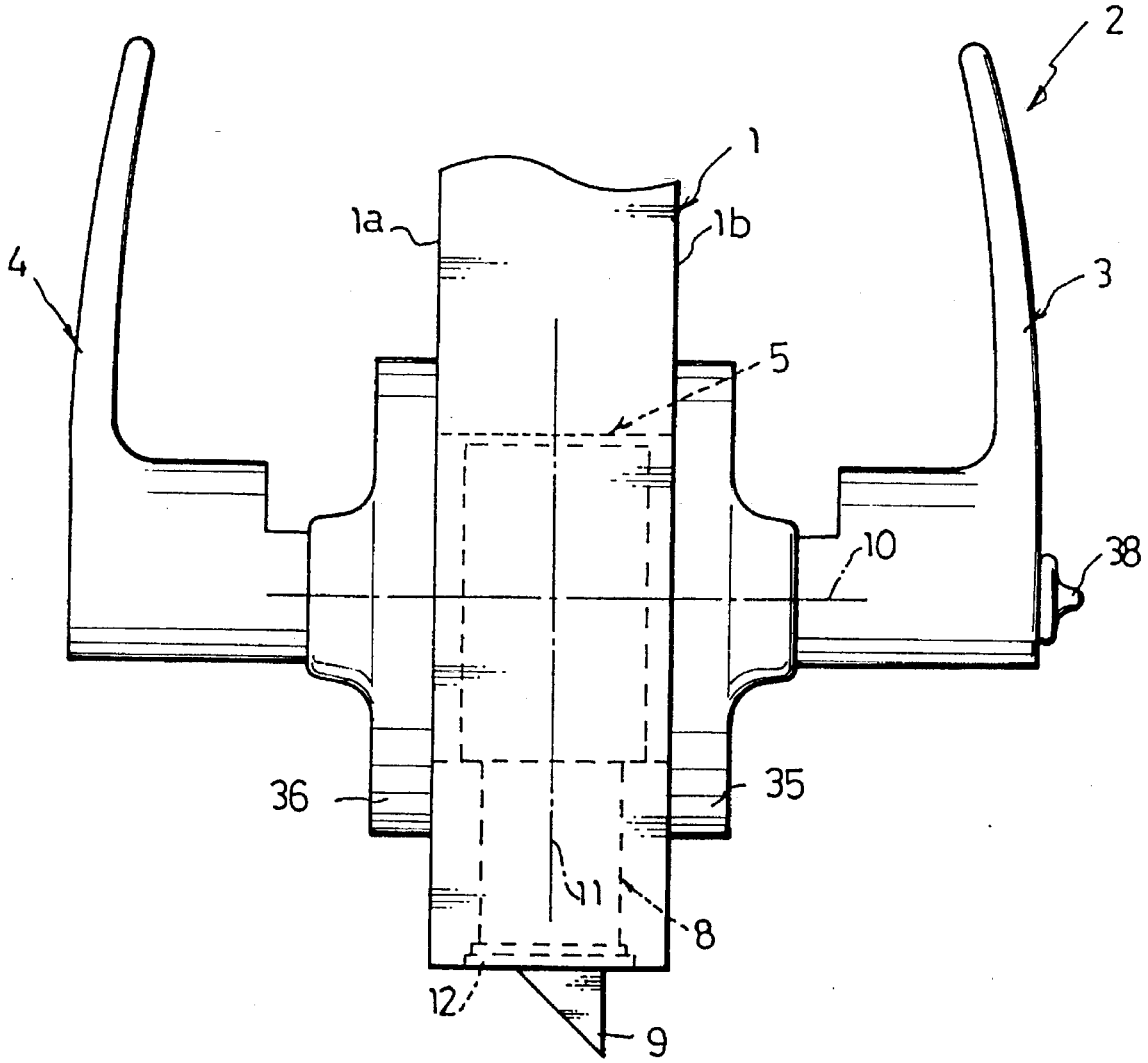
Fig. 12 PRIOR ART
FIG. 12 is a top plan view showing the attachment state of an example of a conventional door lock.
Figure 13:
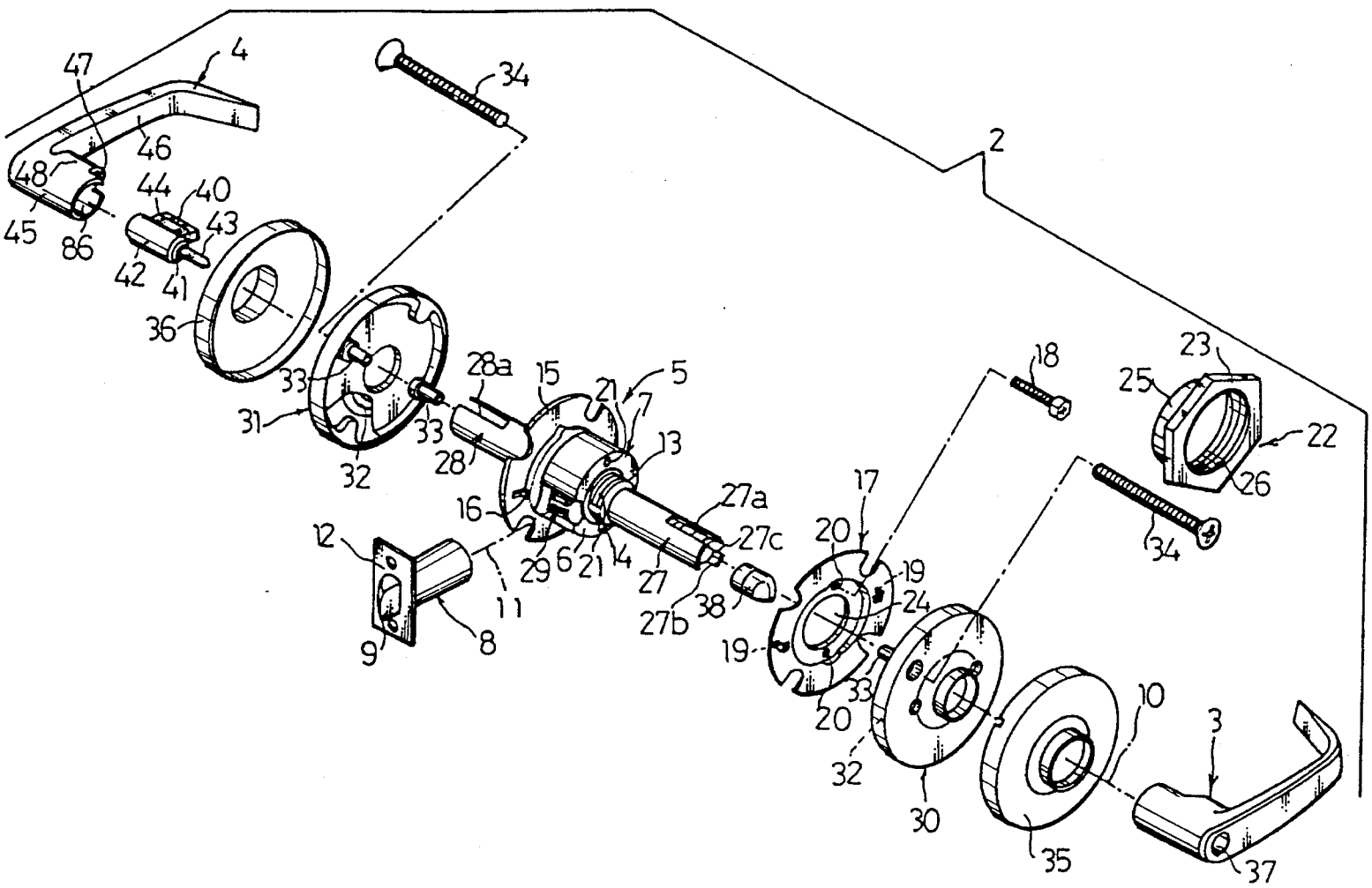
Fig. 13 PRIOR ART
FIG. 13 is an exploded perspective view of the door lock shown in FIG. 12.
Figure 14:
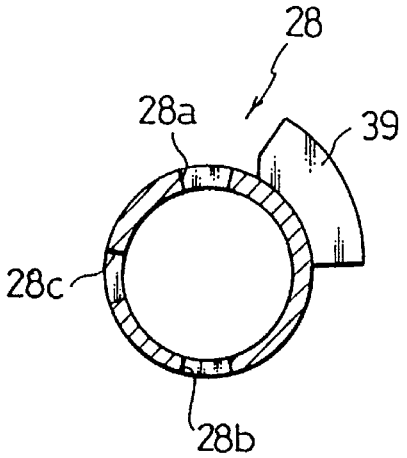
Fig. 14 PRIOR ART
FIG. 14 is an explanatory view of an outside rotary shaft of the conventional door lock.
Figure 15:
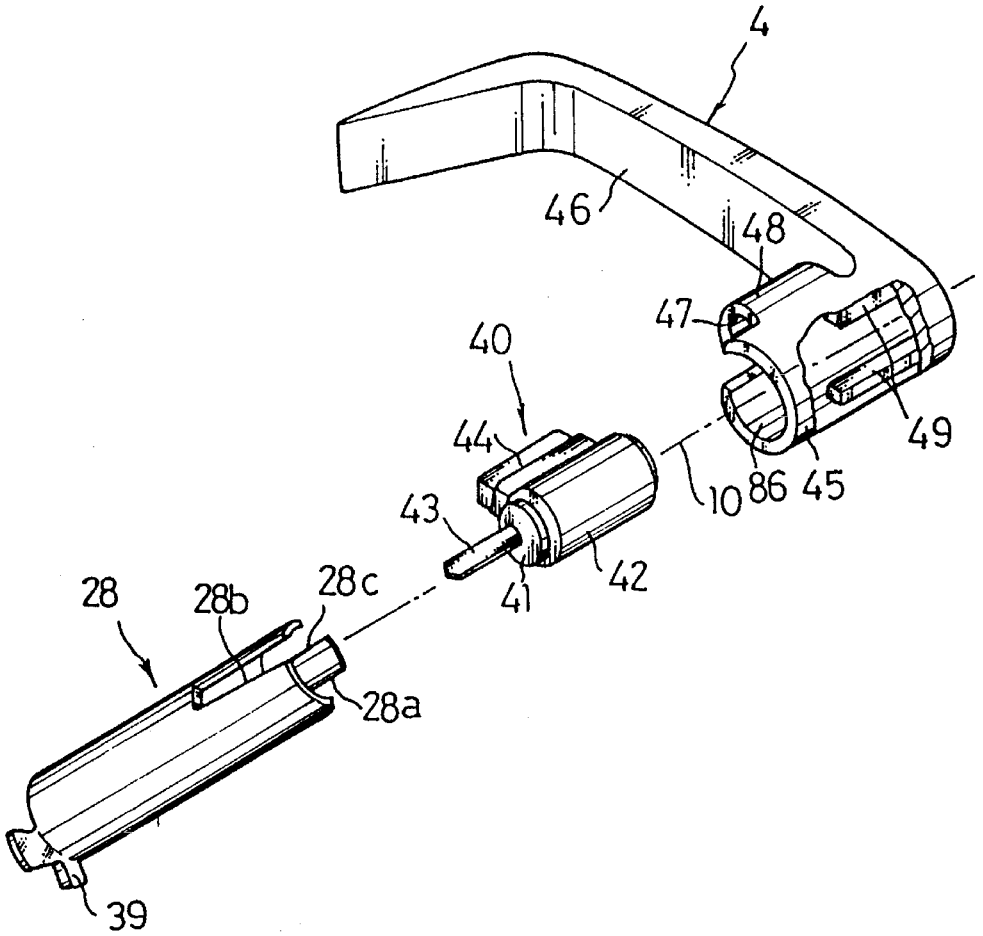
Fig. 15 PRIOR ART
FIG. 15 is an explanatory view showing respective relationships of the essential parts (outside lever handle, cylinder lock, outside rotary shaft) of the conventional door lock.

It is to be noted that, while engagement projections for drive 88, 89, 88B, 89B, 88C, 89C are respectively provided on outside lever handles 4A, 4B, 4C in this embodiment, engagement recessed portions for rotational drive may be employed in place of such engagement projections for drive as shown in FIGS. 10 and 11.

Namely, in this embodiment, two arcuate engagement recessed portions for drive 68 are formed at suitable portions of inner wall 67 of handle 46D connecting to tubular fitting portion 45D of outside lever handle 4D, and outer end portion 69 of outside rotary shaft 28D is engaged with these engagement recessed portions 68 for drive.

Reference numeral 90 denotes a metal abrasion prevention member in a ring form having an engagement hole 91 fitted to respective rotary shafts 27A, 28A and fitted over respective end portions of cylindrical portions 56, 59 of inside bearing member 13A and outside bearing member 13B. This metal abrasion prevention member 90 is formed with synthetic resin.

Reference numeral 92 denotes two tubular decorative members having engagement holes 93 fitted to rotary shafts 27A, 28A, respectively. These decorative members 92 are assembled so that they are loosely fitted into engagement holes 71 of return spring covers 30A, 31A. These decorative members 92 respectively have, at ring shaped portions 94, grooves 95 which can be engaged with stopper pieces 72 of return spring covers 30A, 31A. In addition, these decorative members 92 respectively have tubular decorative portions 96 into which the end portions of tubular fitting portions of lever handles 3A, 4A are fitted.

Reference numerals 35A, 36A denote inside and outside decorative caps disposed on the handle shaft 10A. It is to be noted that turn button 38A is assembled into penetration hole 37A of inside lever handle 3A.

The operation of the door lock thus constructed will now be described.

Initially, when the cylinder lock is in a latch (lock) state, the outside rotary shaft is placed in a latch (lock) state, and therefore does not rotate. When the outside lever handle is rotated, its rotational force is directly transmitted to the outside rotary shaft through engagement projections for drive. Accordingly, a rotational force of the outside lever handle is not directly transmitted to the cover portion of the outer tube of the cylinder lock.

When the cylinder lock is brought into unlatch (unlock) state by insertion of a magnetic key (not shown), the outside rotary shaft is brought into a rotatable state. When the outside lever handle is rotated, the outside rotary shaft rotates together with the outside lever handle by engagement projections for drive or engagement recessed portions for drive of the outside lever handle, and the cylinder lock rotates together with the outside lever handle by drive cut portions of the outside lever handle. At this time, the outer tube of the cylinder lock rotates together with the outside rotary shaft.

In the case where the outside lever handle is rotated in unlatching (unlocking) direction, outside rotary shaft is rotated. Thus, latching slide body is withdrawn into housing of lock body by the cam mechanism.

When a burglar attempts to further forcedly rotate the outside lever handle in excess of the limit (limiting point) of withdrawal movement of latching slide body, a force is applied to engagement rods of inside fixed plate of inside return spring cover through housing. At this time, in the case of the embodiment where a plurality of alignment tubes is used as the measure to counter torsion, which are fitted over the engagement rods, and are fixedly provided at outside fixed plate of outside return spring cover, a force is applied to both alignment tubes 80 and engagement rods through the housing.

Accordingly, since the alignment tubes and the engagement rods are not easily deformed in cooperation with each other, the housing of the lock body is not rotated. As a result, the latch bolt is not disengaged from the latching slide body of the lock body.

As should be apparent from the foregoing description, this invention provides the following effects/advantages.

(1) Since the cut portion 87 for drive disposed opposite to slot 47A of enlarged portion 48A is formed at inner circumferential wall 86 of tubular fitting portion 45A of outside lever handle 4A, and left and right cover portions 84, 85 projecting from the the outer tube 42A of the cylinder lock 40A are respectively fitted to the cut portion for drive and the slot through left and right cut portions 82, 83 of outside rotary shaft 28A, even when there is employed a door lock of lever handle type using a cylinder lock having cover portions in a projection form on the left and right sides of outer tube, it is sufficient to employ two cut portions in outside rotary shaft 28A.

Namely, cylinder lock 40A does not rotate only through a third cut portion of the outside rotary shaft as in the conventional door lock, but rotates through the cut portion 87 for drive of the outside lever handle 4A when the outside rotary shaft 28A is in a rotatable state.

Accordingly, the number of cut portions on the outside rotary shaft can be reduced. As a result, there is no possibility that the existence of cut portions decreases the strength of the outer end portion of the outside rotary shaft.

(2) Since at least two engagement projections 88, 88B, 89, 89B which are respectively in contact with the end surface of a cut portion of the end portion of outside rotary shaft 28A are formed at suitable portions of inner circumferential wall 86 of tubular fitting portion 45A, even if one forcedly rotates outside lever handle when the cylinder lock is in lock (latch) state, its rotational force is directly transmitted to the outside rotary shaft through the engagement projections for drive actuation. Accordingly, since a rotational force of the outside lever handle is not directly transmitted to a cover portion of the outer tube of the cylinder lock, it is possible to protect the cover portion of the cylinder lock.

(3) When a burglar attempts to further forcedly rotate the outside lever handle 4A in excess of the limit (limiting point) of withdrawal movement of latching slide body 29A, housing 7A of the lock body 5A is not easily rotated. Accordingly, latch bolt 9 of latch 8 does not slip off from latching slide body 29A of lock body 5A.

(4) In the case of the embodiment where the outside fixed plate 17B stuck into the wall surface 1*a* of the door 1A is provided at the lock body 5A, and a plurality of alignment tubes 80 are used as the measures to counter torsion, which tubes are fitted over engagement rods 77 of inside fixed plate 17A and are fixedly provided on the outside fixed plate 17B, the advantage of the above-mentioned item (3) can be further exhibited.

What is claimed is:

1. A door lock for a door which comprises an inside lever handle (3A) and an outside lever handle (4A) attached to a lock body (5A) for assembling into the door, a latch (8) including a latch bolt arranged on a latch axis perpendicular to a handle axis said latch bolt is operated by rotation of an inside or outside rotary shaft (27A, 28A) of the lock body, said outside lever handle includes an enlarged outer portion (48A) that includes a tubular fitting portion (45A), said tubular fitting portion includes a slot cut portion (87) opposite to a slot (47A) in said enlarged outer portion (48A), said slot cut portion (87) and said slot (47A) are formed at an inner circumferential wall of said tubular fitting portion (45A) of the outside lever handle, a cylinder lock (40A) that includes left and right projected cover portions (84, 85) in a projection form of an outer tube (42A) of said cylinder lock, said left and right cover portions (84, 85) are respectively fitted into the slot cut portion (87) and slot (47A) of said tubular fitting portion (45A), for driving the cylinder lock said outside rotary shaft (28A) includes oppositely disposed left and right cut portions (82, 83) which receive one end of said left and right projected cover portions (84, 85) of said cylinder lock, and said left and right cut portions of the outside rotary shaft align with suitable portions of the inner circumferential wall of the tubular fitting portion.

2. A door lock as set forth in claim 1, wherein engagement projections for the left and right projected cover portions for drive by said outside lever handle are formed so that they are diametrically opposite to the inner circumferential wall of the tubular fitting portion forming the slot cut portion for drive.

3. A door lock as set forth in claim 1, wherein engagement projections for the left and right projected cover portions for drive by the outside lever handle are formed diametrically symmetrically to the inner wall of the tubular fitting portion forming the slot cut portion (87) for drive and the inner wall forming the slot (47A) of the enlarged portion (48A).

4. A door lock as set forth in claim 1, wherein a plurality of engagement portions which function to counter torsion are formed at a housing of the lock body, and a plurality of engagement rods that engage with engagement portions are fixedly provided at an inside fixed plate for extension into an inner wall surface of the door.

5. A door lock comprising a lock body, an inside lever handle and an outside lever handle which are attached to the lock body for assembly into a door, said lock body includes an inside and an outside rotary shaft, a retracting operation of a latch bolt of a latch arranged on a latch axis perpendicular to a handle axis is carried out by rotation of said inside or outside rotary shaft of the lock body, said outside lever handle includes an enlarged outer portion (48A) that includes a tubular fitting portion (45A), said tubular fitting portion includes a slot cut portion (87) opposite to a slot (47A) in said enlarged outer portion (48A) of said outside lever handle at an inner circumferential wall of said tubular fitting portion (45A) of the outside lever handle, a cylinder lock (40A) that includes left and right projected cover portions in a projection form of an outer tube (42A) of the cylinder lock, said left and right cover portions (84, 85) are respectively fitted into the slot cut portions and slot for (47A) drive by said outside handle and the outside rotary shaft includes left and right cut portions into which said left and right projected cover portions interfit, and that two arcuated engagement recessed portions (68) are formed at suitable portions of an inner wall of the outer handle connecting to the tubular fitting portion of the outside lever handle, and outer end portions of the outside rotary shaft engage with these engagement recessed portions for drive by the outside lever handle.

* * * * *